United States Patent [19]

Chow

[11] 4,452,391

[45] Jun. 5, 1984

[54] AIR REGULATING DEVICE

[75] Inventor: Vincent Y. S. Chow, Hanover Park, Ill.

[73] Assignee: Ellsworth, Chow & Murphy, Inc., Palo Alto, Calif.

[21] Appl. No.: 323,411

[22] Filed: Nov. 20, 1981

[51] Int. Cl.[3] ..... F24F 13/06

[52] U.S. Cl. ..... 236/49; 98/102; 98/106; 236/1 B; 251/65; 251/129; 251/298

[58] Field of Search ..... 98/102, 106; 236/1 B, 236/49; 251/65, 129, 298; 292/251.5

[56] References Cited

U.S. PATENT DOCUMENTS

| | | | |
|---|---|---|---|
| 2,765,802 | 10/1956 | Rowell | 251/65 X |
| 2,888,036 | 5/1959 | Reppert | 251/298 X |
| 3,212,751 | 10/1965 | Hassa | 251/65 |
| 3,360,005 | 12/1967 | Sopher et al. | 251/65 |
| 3,422,841 | 1/1969 | Farrer | 251/65 X |
| 3,934,797 | 1/1976 | Perlmutter | 236/1 B X |
| 4,121,741 | 10/1978 | Adamson | 251/65 X |
| 4,277,019 | 7/1981 | Shreve | 236/49 |
| 4,394,958 | 7/1983 | Whitney et al. | 98/106 X |

*Primary Examiner*—Albert J. Makay
*Assistant Examiner*—Harold Joyce
*Attorney, Agent, or Firm*—Neuman, Williams, Anderson & Olson

[57] ABSTRACT

An automatic air regulating device for use in a forced air heating or cooling system whereby air vents or ducts leading to various rooms within a building may be automatically opened or closed to conserve energy. The automatic air regulating device of the present invention utilizes airfoil shaped dampers rotatable between open and closed positions within the building's air ducts. This airfoil shape thus provides for efficient and inexpensive operation of the dampers by utilizing the forced air flowing through the system for its operating forces. The dampers are further controlled by operation of restraining means which establish opening and closing conditions of the dampers in response to programmed or timed parameters set according to desired occupancy or use patterns within the building.

4 Claims, 3 Drawing Figures

AIR REGULATING DEVICE

BACKGROUND OF THE INVENTION

This invention relates generally to temperature control systems and more particularly to the automatic regulation of conditioned air in residential or commerical buildings which utilize forced air for heating or cooling.

In recent years, it has become increasingly important and necessary to conserve and optimize energy utilization for temperature control systems in both residential and larger commercial buildings. Accordingly, the environmental control field has become very competitive with numerous manufacturers vying for a growing and popular market. In part because of this vigorous competition, the ability to incorporate many desirable features in an energy conservation system, yet to maintain reliability and keep costs low, has become very important.

One method of conserving or optimizing energy in a building having a forced air control system has been to regulate the flow of conditioned air, either heated or cooled, in accordance with time and occupancy conditions within the building. That is, in a residential bi-level home, for example, the energy used for environmental control can be reduced by as much as 35% if homeowners were to close and open appropriate air vents to match the comfort needs of the family; upstairs vents could be closed during daytime hours when the family is predominantly on the first level and downstairs vents could be closed in the night during typical sleeping periods where bedrooms are located on the second floor. Closing off sections of the home will effectively reduce the volume to be heated or cooled and less energy will be required.

For optimum and efficient utilization of the above method, it is preferable that an energy conservation system be automatic in operation. For example, air vents or dampers located within air ducts could be regulated by electric motors in a timed or controlled sequence. Yet problems exist with such systems. Regulating motors themselves require a relatively large amount of energy for operation, thereby reducing the overall effectiveness and purpose of an energy conservation system. In addition, these motors are often too bulky and heavy to conveniently fit in the limited space available in or around air ducts or vents and on typical existing structural support. Furthermore, motorized damper or vent control systems are extremely expensive in component cost, in installation where structural modifications are necessary for sufficient space or support, and even in continued maintenance and use wherein reliability of the motor is of concern.

It is thus desirable to provide an energy conservation system wherein the flow of conditioned air can be automatically regulated, yet wherein the system is highly reliable, is easily installed, is low in cost, and of great significance, does not require a high consumption of energy or power for use in operation of the system itself.

SUMMARY OF THE INVENTION

The present invention provides an improved automatic air distribution and regulating system within a building utilizing forced air for heating or cooling. This system includes, as its primary component, a series of dampers or control plates in the shape of airfoils, each positioned within an air supply duct. The dampers may be attached to a relatively small support frame which can easily be inserted into the existing ductwork of the building.

Each airfoil-shaped damper of the present invention is rotatable between an open and a closed position, opening and closing the air duct to the flow of air therethrough and thus regulating the supply of conditioned air to the various rooms or sections within a building. In operation, each damper will be automatically closed by the forced, conditioned air flowing through its particular air duct unless otherwise held open by a programmed or timed restraining means. Specifically, when no conditioned air is flowing through the duct, each damper is normally held in its open position, this being substantially parallel to the airduct and with its leading edge directed into the direction of the airflow. When air is forced through the system, such as when the building furnace or air conditioner fan is turned on, the airfoil shape establishes lift forces on the damper, urging it into rotation to its closed position, substantially perpendicular to the airduct. When it is desired to maintain a particular airduct open in accordance with time and occupancy conditions within the building, there is further provided programmed or timed restraining means to hold each damper open against the lift forces referenced above. This restraining means includes, in the preferred embodiment described in detail below, a ferromagnetic plate attached to one section of each damper and an associated magnet attached to the end of a bidirectional electrical solenoid. The solenoid may also be attached to the support frame of each damper. Under programmed conditions, the solenoid operates to position the magnet either closer to or further away from the ferromagnetic plate, thereby establishing strong or weak attractive forces therebetween. When the magnet is nearer to the damper, sufficient attractive forces will be created to hold that damper open. On the other hand, when the magnet is in its retracted position, the attractive forces will be reduced such that the damper can be closed under the lift forces acting thereon. In this manner, the present invention provides for an efficient air regulating system by automatically opening and closing specific air duct passageways to various rooms and sections of a building and further conserves energy by utilizing the very airflow through the duct for its own operation. Such a control device is comprised of few components, further reducing the cost and increasing the reliability of the system, and takes up very little space.

Accordingly, it is an object of the present invention to provide a new and improved automatic air regulating device for use in conserving heating or cooling energy in residential or commerical buildings.

It is another object of the present invention to provide a new and improved air regulating device which itself requires a low consumption of power for use and operation.

It is still a further object of the present invention to provide a new and improved air regulating device which utilizes few parts and is thus reliable in operation and low in cost.

It is yet another object of the present invention to provide an air regulating device which is easily installed and easily added to existing forced air heating or cooling systems.

Further objects and advantages for the present invention will become apparent as the following description proceeds, and the features of novelty which characterize the invention are pointed out with particularity in the claims annexed to and forming a part of this specification.

BRIEF DESCRIPTION OF THE DRAWINGS

For a better understanding of the present invention, reference may be had to the accompanying drawings in which.

DESCRIPTION OF THE PREFERRED EMBODIMENT

Figure 2:
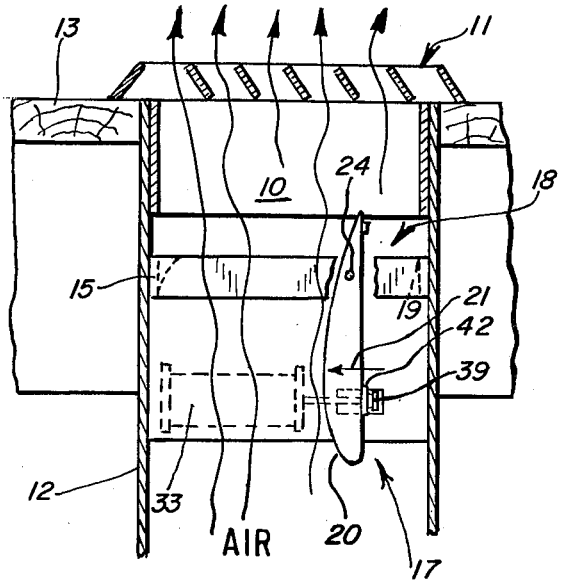
FIG. 2 is a cross-sectional view of the automatic air regulating device of the present invention with the airfoil shaped damper in its open position as used at an air discharge vent location.
Figure 3:
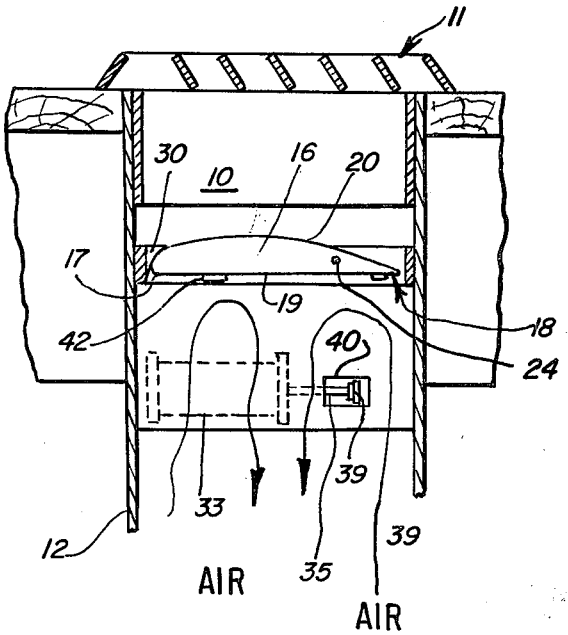
FIG. 3 is a cross-sectional view as is FIG. 2 but with the airfoil shaped damper in its closed position.

Referring now to the drawings, wherein like-referenced characters designate the corresponding parts throughout the several views, there is shown an individual air regulating device designated generally by the reference numeral 10. It is to be understood that several of such devices 10 are to be used throughout the building, one such device at every location wherein it is desired to control or regulate the flow of conditioned air therethrough. For example, as shown in FIGS. 2 and FIG. 3, an air regulating device 10 may be located directly beneath an air vent 11 and within an air duct 12. The device as shown is for a floor unit wherein the vent 11 is positioned on a floor 13 covering the opening of the air duct 12. The present invention may also be used, however, with wall located air vents and with air regulating devices positioned further within the building ductwork.

Figure 1:
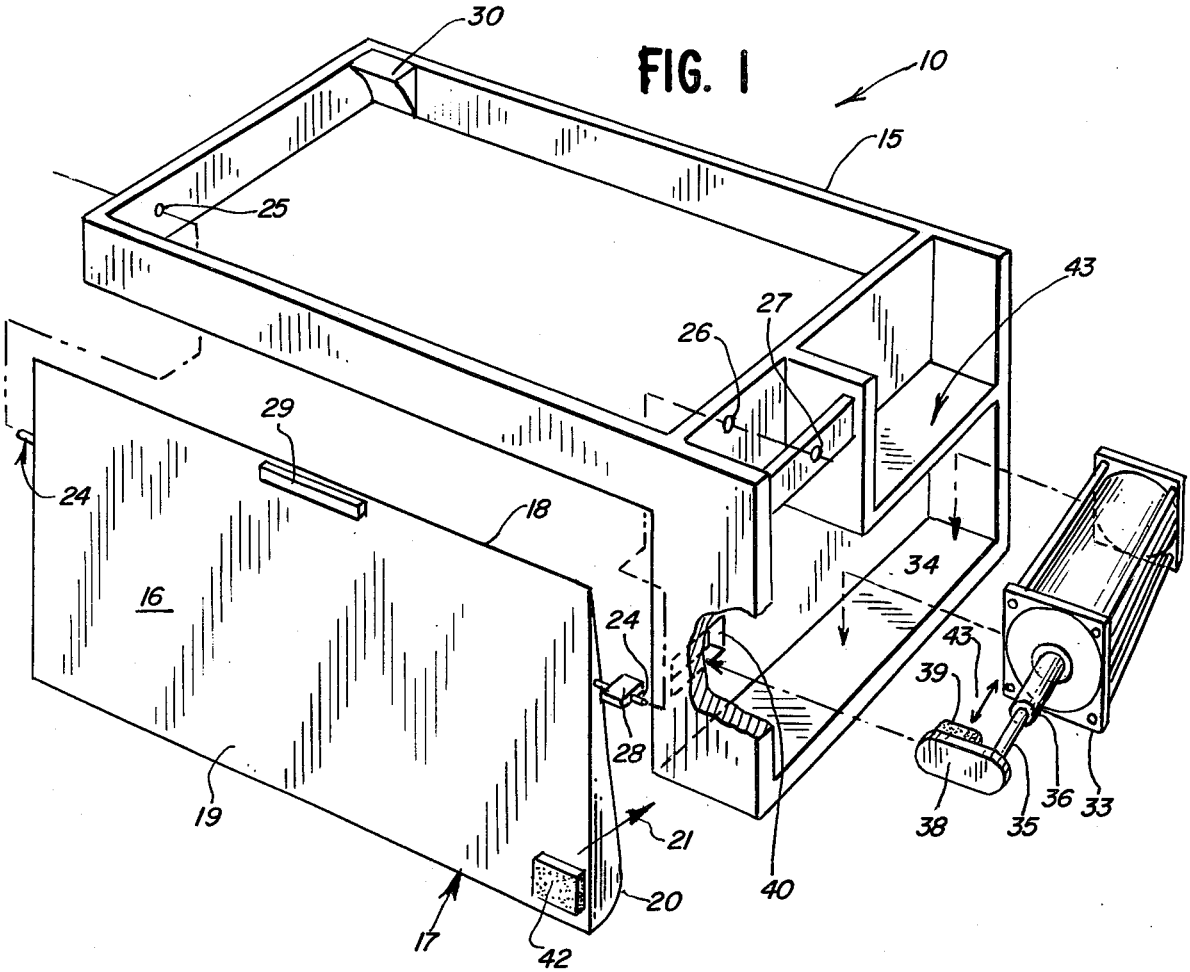
FIG. 1 is a fragmentary perspective view of the automatic air regulating device embodying the novel features of the present invention with parts broken away for clarity.

As viewed in FIG. 1, the air regulating device 10 includes a frame 15 for securing the various components used. Thus, for use of the invention by adding to an existing building, this frame is easily inserted within an air duct 12 beneath the vent 11. The frame may be secured within the air duct in any well known manner such as by expansion clamps secured to the frame or simply by the use of small screws.

Rotatably connected within the frame 15 is an airfoil-shaped control plate or damper 16, having a leading edge 17 and a trailing edge 18. This damper further contains, as in typical airfoil configurations, a substantially flat underside 19 and a curved top-side 20 such that air flowing past the damper from the leading edge 17 toward the trailing edge 18 will create "lift" forces on the damper. These lift forces are generally indicated by the arrow labeled 21 and extend in a direction from the underside 19 toward the topside 20.

The damper 16 is rotatably mounted on the frame 15 by a shaft member 24 extending through or out from the sides of the damper. One end of shaft member 24 is inserted through a support hole 25 in the frame whereas the other end of the shaft is supported in frame support holes 26 and 27, as all shown in FIG. 1. The shaft 24 is located toward the trailing edge 18 of the damper 16 and behind the center of lift caused by the lift forces 21. In this manner, the lift forces 21 will cause the damper 16 to rotate in a clockwise direction as shown in FIG. 2 about shaft 24 when air is flowing past the damper.

As previously stated, the damper 16 is normally in its open position when no air is flowing through the duct. When open, the damper is substantially parallel to the air duct as shown in FIG. 2, thereby allowing air to pass around it. In the floor located unit shown in the drawings, this normally open position is established by gravity, with the support shaft 24 also located behind (toward the trailing edge 18) the center of gravity of the damper 16. For a wall located unit, however, there must be provided a countertorque spring to urge the damper to a normally open position. Such a countertorque spring 28 is shown in FIG. 1 on shaft 24 to be positioned between the frame supporting holes 26 and 27. A simple rubberband or leaf spring arrangement can be used for this purpose. The damper should nevertheless be relatively balanced about shaft 24 so that very slow airflow will provide sufficient lift forces to rotate it closed when desired. This balance is achieved by a counterweight 29 secured toward the trailing edge of the damper. The counterweight and resulting balance will also minimize the force required by the countertorque spring 28 to maintain wall located units normally open.

When air flows through the duct, such as by the central furnace or air conditioning fan being turned on, the airflow will establish lift forces 21 as previously noted, tending to rotate the damper 16 clockwise as viewed in FIG. 2. Such rotation will continue until the leading edge 17 abuts a stop member 30 extending in from frame 15, whereupon the damper will then be in its closed position as shown in FIG. 3. The latter position effectively blocks passage of conditioned air through the duct 12, cutting off or at least reducing the supply of such conditioned air to the room or section of the building located past vent 11. As can be seen, the closing operation of the damper 16 is thus efficiently accomplished using the airflow through the ductwork, not consuming any additional power or energy on its own, and requiring only one, simple rotatable component.

To regulate each damper for appropriate opening and closing, that is, keeping it open when desired to heat or cool a room and closing it only when desired to shut off the room from the supply of conditioned air, it is only necessary with the present invention to provide means restraining the damper in its open position at controlled or set periods; without such restraint, each damper will automatically close under action of the lift forces described above. In the preferred embodiment, this restraining means is made up of a controlled magnet assembly located at each damper which can be triggered manually or be programmed or timed for automatic operation. Specifically, an electronically operated bidirectional solenoid 33 is secured within a compartment 34 located within the frame 15.

The solenoid 33 has an axially moveable arm 35 located within a sleeve 36. At the end of arm 35 opposite the solenoid 33, there is further located a laterally extending connecting plate 38 with a permanent magnet 39 attached thereto. When the solenoid 33 is secured within frame 15, the connecting plate 38 and magnet 39 extend through an elongated slot 40 in the frame toward the rotatably mounted damper 16. In close proximity to where the magnet 39 extends through slot 40, there is positioned on the underside 19 of damper 16 a ferromagnetic plate 42.

In operation, the arm 35 of bidirectional solenoid 33 is axially operable in the direction shown by arrow 43 in FIG. 1 to an extended position away from the solenoid 33 and a retracted position toward the solenoid. In its retracted position, the magnet 39 is located in close proximity to the ferromagnetic plate 42, establishing sufficient attractive forces therebetween to restrain the damper 16 in its open position against lift forces 21. In its extended position, however, the magnet 39 is positioned further away from the plate 42 such that the attractive forces therebetween are sufficiently weak. The damper will thus not be restrained and be free to close. This operation is clearly shown in the drawings, wherein there is shown in FIG. 2 the arm 35 in its retracted position, extending toward one end of slot 40, and magnet 39 abutting ferromagnetic plate 42 restraining movement of the damper 16. In FIG. 3, on the other hand, the arm 35 and connecting plate 38 with magnet 39 attached thereto are shown in the extended position, extending toward the opposite end of slot 40, whereby the damper 16 is allowed to rotate to its closed position. By the use of such a magnet assembly, the preferred embodiment described avoids the problems of mechanical latch arrangements which could rattle when restraining the damper. Furthermore, activities of the magnet assembly need not be timed to the position of the damper as a mechanical latch would have to be. That is, even if the damper happens to be in its closed position in the preferred embodiment, away from the magnet assembly when the solenoid is activated for restraint, the damper will still be effectively latched as soon as the air flow stops at the end of the central fan cycle and the damper returns open.

The solenoid 33 can be activated in any of several well-known manners. For ease in installation, it is preferably battery operated and controlled by wireless radio frequency signals, although direct wiring systems can also be utilized. Batteries and appropriate electronics for such signals can be conveniently positioned in a compartment 43 within the frame 15. In the preferred embodiment the solenoid 33 is furthermore a pulse type unit whereby only a short pulse is necessary to initiate axial movement of arm 35. In this manner, conservation of energy is additionally maintained since continuous power is not necessary to maintain arm 35 in either of its positions.

A central control panel for operating each respective damper, either by manual switches or under a timed or programmed sequence, is then located at a convenient station within the building. For non-manual timed or programmed usage, several different thermostat units at separate locations throughout the building is also preferable for controlling the central furnace or air conditioner fan.

It has thus been shown and described above an efficient manner to close or open various air passageways or vents leading to different rooms or sections within a building. This will then allow selected rooms or sections to be opened or closed to conditioned air when the central furnace or air conditioning fan is turned on in order to conserve energy. The system described utilizes very little power for its own operation and, in being constructed by a relatively few number of parts, is highly reliable and low in cost.

While there have been shown and described several embodiments of the present invention, it will be apparent to those skilled in the art that numerous changes and modifications may occur, and it is intended in the appended claims to cover all such changes and modifications which fall within the spirit and scope of the present invention.

What is claimed as new and desired to be secured by Letters Patent of the United States is:

1. An air regulating device for use within an air duct of a forced air heating or cooling system, said regulating device comprising an airfoil shaped damper having a leading edge along one side thereof; means for pivotally mounting said damper within said air duct along an axis parallel to said leading edge; said damper rotatable about said mounting means between an open position, allowing for airflow through said air duct, and a closed position, substantially blocking airflow through said air duct; said damper shape and the placement thereof within said air duct urging said damper to rotate to its closed position when air is flowing through said air duct; restraining means made of a metallic strip attached to and selectively operable to prevent rotation of said damper and magnetizing means secured within said air duct selectively operable for magnetic engagement or disengagement with said metallic strip, whereby said damper is restrained from rotation when said magnetizing means is in magnetic engagement with said metallic strip and said damper is free to rotate when said magnetizing means is disengaged from said metallic strip.

2. An air regulating device as claimed in claim 1 wherein said magnetizing means comprises a permanent magnet attached to an electrically operable solenoid whereby said magnet is movable between a first position extending toward and in magnetic engagement with said metallic strip and a second position distant from and in magnetic disengagement with said metallic strip.

3. An air regulating device for use with a forced air heating or cooling system, having an elongated air duct and a fan creating air flow therethrough upon operation of said fan, said regulating device comprising: a damper having a leading edge along one side thereof and a trailing edge along the oposite side thereof; means for pivotally mounting said damper within said air duct along an axis parallel to said leading edge; said damper rotatable about said mounting means between an open position, having the plane between said leading edge and said trailing edge substantially parallel to said air duct, and a closed position, having said plane substantially perpendicular to said airduct; means urging said damper to its open position when the fan is not operating and no airflow is passing through said duct; said damper formed in the shape of an airfoil to establish lift forces thereon perpendicular to said plane when airflow passes thereover and whereby said lift forces urge said damper to its closed position when the fan is operating and airflow is passing through said duct; restraining means made of a metallic strip attached to said damper and selectively operable to hold said damper in its open position against the urging of said lift forces; and magnetizing means secured within said air duct selectively operable for magnetic engagement or disengagement with said metallic strip whereby said damper is held in its open position upon magnetic engagement between said metallic strip and said magnetizing means.

4. An air regulating device as claimed in claim 3 wherein said magnetizing means comprises a permanent magnet attached to an electrically operable solenoid whereby said magnet is movable between a first position extending toward and in magnetic engagement with said metallic strip and a second position distant from and in magnetic disengagement with said metallic strip.

* * * * *